United States Patent [19]

Hanssen

[11] Patent Number: 4,676,293

[45] Date of Patent: Jun. 30, 1987

[54] IMPACT-RESISTANT OVERHEAD DOOR

[75] Inventor: David H. Hanssen, Dubuque, Iowa

[73] Assignee: Frommelt Industries, Inc., Dubuque, Iowa

[21] Appl. No.: 707,180

[22] Filed: Mar. 1, 1985

Related U.S. Application Data

[63] Continuation of Ser. No. 476,776, Mar. 18, 1983, which is a continuation of Ser. No. 289,167, Aug. 3, 1981.

[51] Int. Cl.[4] ..... E05D 15/18

[52] U.S. Cl. ..... 160/201; 160/330

[58] Field of Search ..... 160/190, 200, 201, 205, 160/330, 354, 338

[56] References Cited

U.S. PATENT DOCUMENTS

| | | | |
|---|---|---|---|
| 974,699 | 11/1910 | Ogden | 160/201 |
| 1,783,378 | 12/1930 | Ferris | 160/200 |
| 2,122,532 | 7/1938 | Mins et al. | 160/330 |
| 2,514,370 | 7/1950 | Bunnell | 160/190 |
| 2,629,435 | 2/1953 | Dadswell | 160/190 |
| 2,720,920 | 10/1955 | Eckel | 160/354 |
| 2,815,808 | 12/1957 | Eckel | 160/354 |
| 2,907,383 | 10/1959 | Kloote et al. . | |
| 2,938,578 | 5/1960 | Stull, Jr. . | |
| 2,951,533 | 9/1960 | Lucas et al. . | |
| 3,023,804 | 3/1962 | Howell, Sr. . | |
| 3,034,575 | 5/1962 | Stroup . | |
| 3,090,427 | 5/1963 | Stroup et al. . | |
| 3,140,508 | 7/1964 | Switzguble | 160/201 |
| 3,648,755 | 3/1972 | Thiele . | |
| 3,654,730 | 4/1972 | Fraleigh . | |
| 3,734,161 | 5/1973 | Pierce . | |
| 4,122,887 | 10/1978 | Dussault et al. . | |

*Primary Examiner*—Ramon S. Britts
*Assistant Examiner*—Cherney S. Lieberman
*Attorney, Agent, or Firm*—Emrich & Dithmar

[57] ABSTRACT

A multi-section overhead door having an impact-proof bottom panel for improved safety and durability is disclosed. The door is displaced vertically along parallel tracks to which it is coupled by means of rollers. Impact with the bottom panel of the door when in a raised position results in the disengagement of the track rollers from the bottom panel and the displacement of the bottom panel from alignment with the tracks. With the impact force removed, the bottom panel resumes its original position between the tracks to which it can be remounted by conveniently repositioning the track rollers thereon. The bottom panel includes front and rear rubber surfaces with a urethane filler therebetween and a flexible bottom nosing seal.

13 Claims, 7 Drawing Figures

IMPACT-RESISTANT OVERHEAD DOOR

This is a continuation of application Ser. No. 476,776, filed Mar. 18, 1983, which was a continuation of application U.S. Ser. No. 289,167, filed Aug. 3, 1981.

BACKGROUND OF THE INVENTION

This invention relates generally to track-mounted, articulated overhead doors and particularly relates to an improved overhead door having an impact-resistant, knock-out bottom section.

Overhead doors having an articulated construction, such as those generally employed in garages, warehouses, or other enclosed structures, typically involve the use of a plurality of panels extending transversely across the door opening and arranged in a vertical linear array with adjacent edges of the panels flexibly coupled by means of hinges. This flexibility permits the door to be moved from a generally vertical orientation immediately adjacent the opening to an overhead horizontal position by means of a pair of parallel, curved tracks located on each side of the multi-sectioned door. The guide trackways generally include a vertical section which positions the door adjacent the opening, a horizontal section at the upper end of the vertical section that determines the open position of the door, and a curved section connecting the vertical and horizontal sections and over which the panels travel between the vertical and horizontal positions. The relative orientation of the door and the tracks is maintained by means of rollers coupled to the various sections of the door and positioned within and engaging the guide tracks. Each of the roller shafts is rigidly affixed to a section, or panel, of the door while the rotating portion of the roller which is mounted on the shaft engages the tracks, with its movement thereby constrained in guiding the door along the tracks.

While this type of door offers clear advantages in terms of ease of handling and storage in the open position, it has also suffered from various installation and operating limitations. The prior art discloses many approaches to solving design, construction and installation problems associated with these doors as evidenced by the following patents, and the improvements they represent, in this field: U.S. Pat. Nos. 2,907,383 to Kloote et al (plastic rollaway door for reduced weight and improved environmental durability); 2,938,578 to Stull (improved weather-tight door seal); 2,951,533 to Lucas et al (light-weight garage door assembly with interchangeable interlocking articulated sections); 3,023,804 to Howell (improved door lower seal and positioning means); 3,034,575 to Stroup (vertically acting door with improved seals); 3,090,427 to Stroup et al (upwardly acting door assembly with adjustable door jamb and sill seal positioning and locking means); 3,648,755 to Thiele (combination connecting cover/seal strip and hinge for inter-panel space of articulated doors); 3,654,730 to Fraleigh (flexible barrier extending across bottom portion of overhead door opening for intercepting debris); and 3,734,161 to Pierce (curtain-type overhead door with flexibly interlocking substantially flat panels which are rolled onto a barrel or drum).

Still another approach to a flexible partition for covering an opening is disclosed in U.S. Pat. No. 4,122,887 to Dussault et al which describes a pliant curtain closure supported by its upper edge and a portion of one side edge and which includes a window cut-out and attached weights to provide inertia when the closure is opened or when it is returned to its closed position.

Thus, it is readily apparent that the search for improvements in flexible, overhead doors has been rather extensive and intense. To date, however, the problem of damage to an overhead door caused by the impact of an object, such as a moving vehicle, with the door has not been addressed. An impact force applied to the lower section of the door when in the open or a partially closed position represents a constant potential source of damage thereto involving expensive repairs, temporary loss of the security and environmental protection provided by the door, and repair of the object, such as a forklift, automobile, or truck, impacting the overhead door. The present invention is directed to overcoming this problem and provides an improvement in articulated overhead doors which enhances their durability and safety.

SUMMARY OF THE INVENTION

Accordingly, it is an object of the present invention to provide an improved overhead door compatible with existing parallel track systems and to which existing doors may be easily adapted.

Briefly, the present invention contemplates a multi-section, hinged, overhead door attached by means of hinge-mounted rollers to parallel tracks. The bottom panel of the door is detachably mounted such that upon impact, with the door in a raised position, the bottom panel separates from the rollers, becoming detached from the fixed tracks and displaced by the impact force. Following the removal of the impact force, the resiliency of the bottom panel causes it to return to its original position between the vertical tracks to which it may again be semi-rigidly coupled by means of the rollers. The rigidity of the bottom panel with the door fully down and a bottom nosing seal in contact with the doorway's threshold provides security and an environmental barrier, while the upraised door affords increased safety and greater durability.

BRIEF DESCRIPTION OF THE DRAWINGS

The appended claims set forth those novel features believed characteristic of the invention. However, the invention itself as well as further objects and advantages thereof, will best be understood by reference to the following detailed description of a preferred embodiment taken in conjunction with the accompanying drawings, where like reference characters identify like elements throughout the various figures, in which:

FIG. 6 is a fragmentary top plan view showing displacement of the door outwardly with respect to the door opening in accordance with the present invention; and FIG. 7 is a fragmentary top plan view showing displacement of the door inwardly with respect to the door opening in accordance with the present invention.

DETAILED DESCRIPTION OF THE PREFERRED EMBODIMENTS

Figure 1:
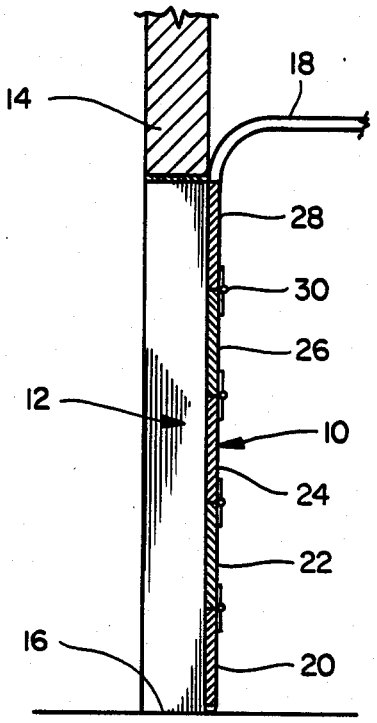
FIG. 1 is a side elevation view of the overhead, impact-resistant door of the present invention in the closed, or down, position.
Figure 2:
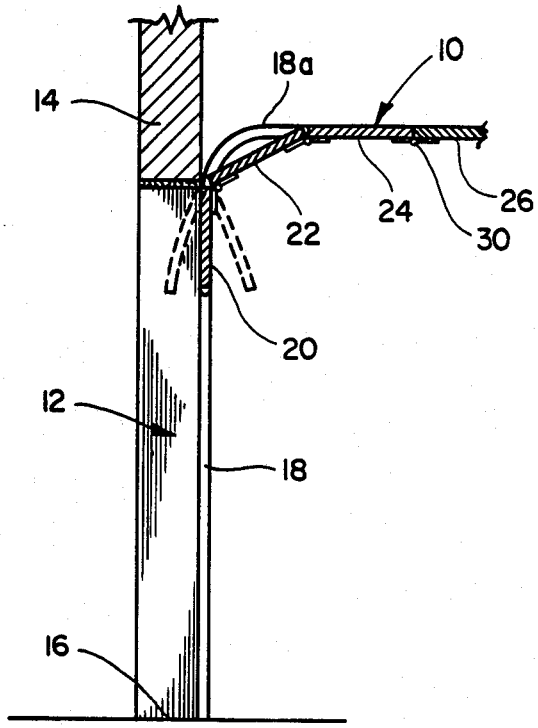
FIG. 2 is a side elevation view of the overhead impact-resistant door in the fully raised position with the displacement of the flexible bottom panel shown in dotted line form.

Referring to FIGS. 1 and 2, there is shown an impact-resistant overhead door assembly 10 in accordance with the present invention in the closed, or down, and open positions, respectively. Overhead door 10 includes a plurality of panels, or sections, including a bottom panel 20, an upper panel 28 and a plurality of intermediate panels 22, 24 and 26 flexibly coupled together by means of hinges 30.

In the closed position overhead door 10 is positioned immediately adjacent to and in front of an opening 12 in a wall 14 with the bottom surface of opening 12 defined by a threshold 16. In the closed position overhead door 10 is oriented in a generally vertical direction while, as shown in FIG. 2, in the upraised, or open, position most of the panels of door 10 assume a horizontal position. Door 10 is moved between the open and closed position and is maintained or held in those positions by means of parallel tracks 18 located immediately adjacent the lateral portions of door 10. Tracks 18 include a curved portion 18*a* which couples the vertical and horizontal sections of parallel tracks 18. The present invention, of course, is not limited to a generally 90° turn in the parallel track configuration, but would work equally well with an entirely vertical track system where means are provided to hold the door in the open position, or any parallel track system where the door in the closed position is oriented between the vertical and horizontal configurations. The advantages in terms of closed door storage are obvious in the parallel track configuration shown in FIGS. 1 and 2.

FIG. 2 shows the overhead door 10 in the fully up position wherein bottom panel 20 extends below the upper surface of opening 12 defined by wall 14. In this configuration, and in any position of overhead door 10 intermediate between the full open and full closed positions, bottom panel 20 is subject to impact with objects moving, or being moved, through aperture 12. Upon impact with bottom panel 20, a moving object will cause the displacement of bottom panel 20 in either an outward or inward direction as shown by the dotted lines in FIG. 2. Heretofore, the imposition of an impact force of sufficient magnitude to so displace bottom panel 20 necessitated expensive and time-consuming repairs to or the replacement of bottom panel 20.

Figure 3:
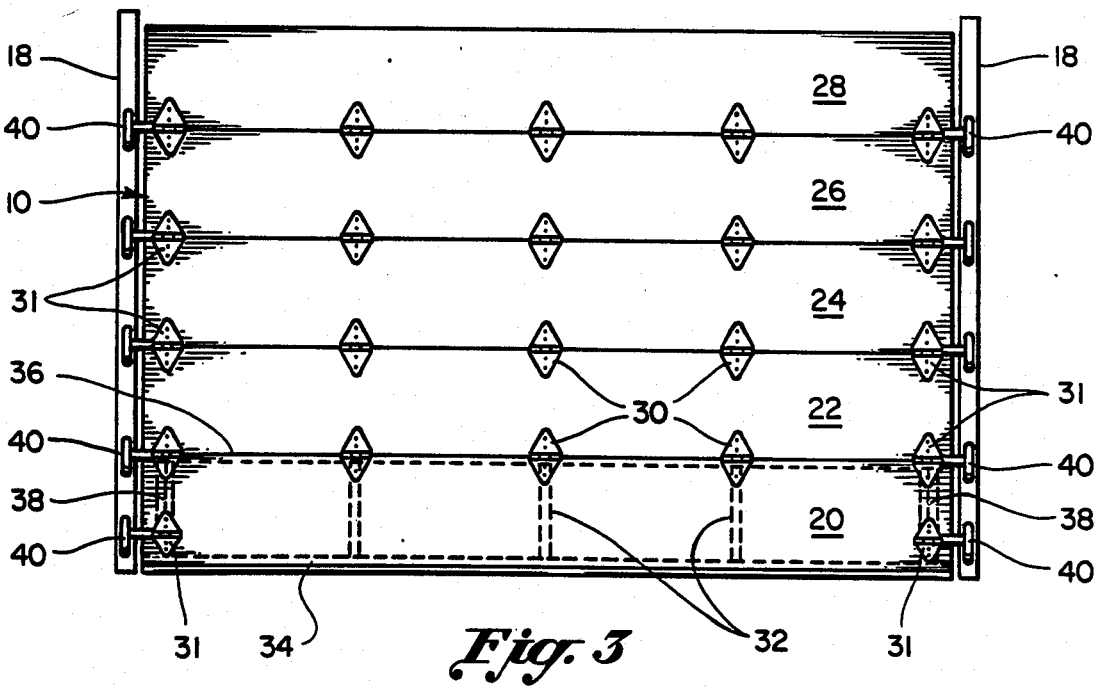
FIG. 3 is a fragmentary inside view of an embodiment of the present invention with the door in the closed position.

Referring to FIG. 3 and in accordance with the present invention, a bottom panel 20 is provided capable of absorbing high impact forces, being displaced rotationally thereby, and resuming its original position between and immediately adjacent parallel tracks 18 following the removal of the impact force.

The edge portions of the panels of overhead door 10 are linked together by means of edge hinges 31 while the central portions of the panels therebetween are coupled by means of inner hinges 30. Thus, bottom panel 20 is flexibly coupled to immediately adjacent panel 22 by means of edge hinges 31 and inner hinges 30. Bottom panel 20 is comprised of a plurality of vertical reinforcing members 32 and lower and upper horizontal reinforcing members 34, 36, oriented at approximately 90° with respect thereto. The vertical reinforcing members 32 are located adjacent where the edge and inner hinges 31, 30 are positioned on bottom panel 20 for structural integrity. Similarly, lower and upper horizontal reinforcing members 34, 36 extend the entire length of bottom panel 20 in providing enhanced reinforcement therefor. The hinges afford the flexibility required of overhead door 10 in traversing the curved portion 18*a* of the parallel tracks 18 while providing structural integrity for the multipanel configuration of overhead door 10. In addition, rollers 40 are rotationally coupled to edge hinges 31 which, in turn, are securely affixed to the lateral portions of each door panel. In this manner, the lateral edge portions of overhead door 10 are maintained in position relative to and guided by parallel tracks 18.

Figure 4:
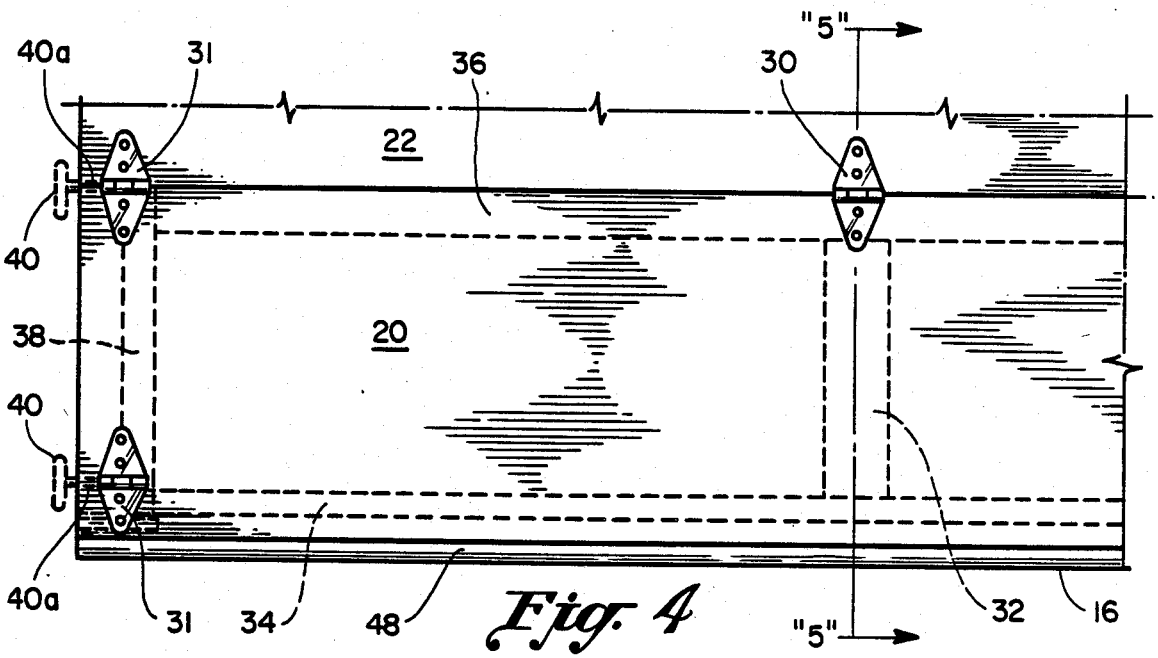
FIG. 4 is an enlarged rear elevation view of part of FIG. 3 with parts broken away and shown in section.

Referring to FIG. 4, there is shown an exploded and partially cutaway view of the lower left portion of the inside surface of overhead door 10 shown in FIG. 3. Attached to edge hinges 31 are rollers 40 which engage the immediately adjacent parallel track (not shown). Rollers 40 are detachably coupled to edge hinges 31 so that they may be removed therefrom by a force exerted on the roller in a direction generally parallel to roller shaft 40*a*. Thus, with rollers 40 engaging the immediately adjacent parallel track 18 in a conventional manner, the displacement of bottom panel 20 due to an impact force applied thereto will cause the edge portions of bottom panel 20 to be displaced away from the adjacent parallel track. This displacement of the edge portions of bottom panel 20 and the hinges rigidly affixed thereto will cause a separation between rollers 40, which are rotationally engaged by the adjacent parallel track 18, and the edge hinges 31. As flexible bottom panel 20 is distorted by an impact force, the bottom panel 20 flexes outward and, in doing so, causes the lateral end portions of the flexible panel 20 near the vertical reinforcing member 32 to fold inwards towards the center of the panel, withdrawing shaft 40 of hinge 31 from a shaft receiving surface in either rollers 40 or in the shaft receiving surface of hinge 31 mounted to the flexible panel 20. With the lateral edges of bottom panel 20 thus disengaged from parallel tracks 18, bottom panel 20 is free to move in response to the applied impact force and to "give" therewith. Thus, the displacement of bottom panel 20 in response to the applied force avoids the breaking, shattering or permanent distortion thereof in response to the applied force. A semi-rigid, flexible bottom nosing seal 48 is attached to the lower edge of bottom panel 20 and positioned in close contact with threshold 16 when overhead door 10 is in the closed position.

Figure 5:
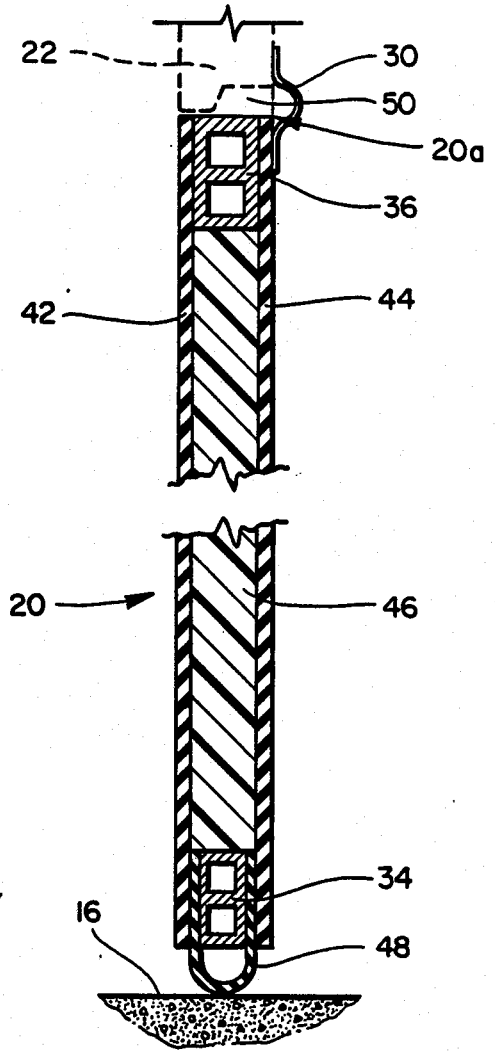
FIG. 5 is a vertical section taken on line 5—5 of FIG. 4.

Referring to FIG. 5, there is shown a sectional view of bottom panel 20 taken along the plane 5—5 of FIG. 4. Bottom panel 20 is shown flexibly coupled to an intermediate panel 22 by means of an inner hinge 30. Immediately adjacent to inner hinge 30 and positioned between bottom panel 20 and intermediate panel 22 is a spacer groove 50 to accomodate the relative rotation of the immediately adjacent panels and more particularly the displacement of the upper right-hand portion 20*a* of bottom panel 20 relative to intermediate panel 22.

In a preferred embodiment of the present invention, bottom panel 20 includes an outer rubber surface 42 and an inner rubber surface 44 between which is provided a urethane filler 46. The combination of the two rubber strips separated by the filler material provides a semi-rigid structure capable of withstanding a high impact force. The interior structure of bottom panel 20 includes lower and upper horizontal reinforcing members 34, 36, each of which is in the form of a double box beam, preferably of molded rubber or of a rubberlike compound. Upper horizontal reinforcing member 36 is firmly affixed to outer and inner surfaces 42, 44, while a U-shaped bottom nosing seal 48 is positioned between the lower horizontal reinforcing member 34 and outer and inner surfaces 42, 44 of bottom panel 20. Vertical reinforcing members 32 are also formed from rubber or a rubber-like compound, while edge reinforcing members 38 in bottom panel 20 are preferably made from an extruded, light-weight metal, such as aluminum. The combination of the rigid edge reinforcing members 38 to which the flexible lower and upper reinforcing members 34, 36 are attached and the resilient vertical reinforcing members 32 afford bottom panel 20 the adaptability and durability required for carrying out the present invention.

In the cavity defined by outer and inner surfaces 42, 44 and lower and upper horizontal reinforcing members 34, 36 polyurethane foam is injected providing an impact-resistant structure for bottom panel 20. The structural integrity of bottom panel 20 to impact forces applied thereto is insured by the rectangular matrices of the vertical and horizontal reinforcing members. Bottom nosing seal 48 is preferably comprised of rubber, or a rubber-like compound, and affords impact flexibility and contact integrity between overhead door 10 and doorway threshold 16. With nosing seal 48 of a semi-rigid consistency and in firm contact with threshold 16 when overhead door 10 is in the closed position, bottom panel 20 may be displaced from its normal position intermediate between parallel tracks 18 only by a transverse force of very considerable magnitude applied thereto. Thus, for security and environmental reasons, overhead door 10 is positioned by means of nosing seal 48 in firm contact with door threshold 16 when in the down position to prevent the displacement of bottom panel 20 from its normal position spanning the lower portion of opening 12.

There has thus been shown an articulated, overhead door having a breakaway bottom panel which avoids costly repairs due to an impact force applied thereto when the door is open while providing security and an environmental barrier when the door is in the closed position.

While particular embodiments of the present invention have been shown and described, it will be apparent to those skilled in the art that changes and modifications may be made therein without departing from the invention in its broader aspects. The aim of the appended claims, therefore, is to cover all such changes and modifications as fall within the true spirit and scope of the invention.

I claim:

1. An impact resistant overhead door assembly movable on parallel tracks from a closed position adjacent an opening to an open position, said door assembly comprising:

a plurality of adjacent, rigid, parallel panels oriented generally end to end with respect to one another;

a plurality of hinges affixed to facing edge portions of adjacent panels for providing flexible coupling therebetween;

rollers rotationally engaging said tracks and said hinges in guiding the movement of said coupled panels along said tracks; and a flexible, resilient bottom panel coupled by means of hinges to an adjacent panel and detachably coupled to a plurality of track-mounted rollers such that upon application of an impact force thereto and the resulting displacement thereof, said bottom panel is detached from said rollers and disengaged from said tracks, with said bottom panel resuming its original position relative to said tracks following the removal of said impact force.

2. The door assembly of claim 1 further comprising a U-shaped, flexible nosing seal coupled to the lower edge portion of said bottom panel and extending the entire length thereof, said nosing seal positioned immediately adjacent the threshold of said opening with said door assembly in the closed position.

3. The door assembly of claim 1 wherein said rollers are coupled to said bottom panel by means of a plurality of hinges fixedly mounted to said bottom panel.

4. The door assembly of claim 1 wherein said bottom panel includes rubber front and back surfaces with a polyurethane foam filler incorporated therebetween.

5. The door assembly of claim 1 wherein said bottom panel includes metal edge reinforcing members positioned in close proximity to the lateral edges of said bottom panel and rubber horizontal and vertical reinforcing members positioned in close proximity to the upper and lower edges of said bottom panel and between said edge reinforcing members, respectively.

6. An impact resistant overhead door assembly moveable on parallel tracks from a closed position adjacent an opening to an open position, said door assembly comprising:

a plurality of adjacent, rigid, parallel panels oriented generally end to end with respect to one another;

a plurality of hinges affixed to facing edge portions of adjacent panels for providing flexible coupling therebetween;

rollers rotationally engaging said tracks and said hinges in guiding the displacement of said coupled panels along said tracks;

a flexible, resilient bottom panel coupled to an adjacent, rigid panel and detachably coupled to a plurality of track-mounted rollers by means of said hinges such that upon application of an impact force thereto the resulting displacement of said bottom panel causes it to become detached from said rollers and disengaged from said tracks, with said bottom panel resuming its original position relative to said tracks following the removal of said impact force, said bottom panel including rubber front and back surfaces with a polyurethane foam filler incorporated therebetween; and a U-shaped flexible nosing seal coupled to the lower edge portion of said bottom panel and extending the entire length thereof, said nosing seal positioned immediately adjacent the threshold of said opening with said door assembly in the closed position.

7. In an articulated overhead door moveably positioned in front of an opening by means of parallel tracks located immediately adjacent the lateral edges of said door, said door including a plurality of rigid, flexibly coupled, end to end positioned, parallel panels, said panels including a plurality of rollers attached to the lateral edges thereof and engaging said tracks for supporting and guiding the movement of said door, the improvement comprising:

a resiliently flexible, impact-resistant bottom panel including a plurality of hinges rigidly affixed thereto for flexibly coupling said bottom panel to an adjacent panel and for detachably coupling said bottom panel to said parallel tracks wherein said hinges are removeably coupled to said rollers engaging said tracks.

8. A impact-resistant overhead door assembly moveable on parallel tracks from a closed position adjacent an opening to an open position, said door assembly comprising:

a plurality of adjacent, rigid, parallel panels oriented generally end to end with respect to one another;

a plurality of hinges affixed to facing edge portions of adjacent panels for providing flexible coupling therebetween;

rollers rotationally engaging said tracks and said hinges in guiding the movement of said coupled panels along said tracks;

a resiliently flexible, bottom panel flexibly coupled to an adjacent rigid panel by means of said hinges; and means for detachably coupling the lateral edge portions of said bottom panel to said tracks such that said bottom panel is disengaged from said tracks and displaced by an impact force applied thereto, with said bottom panel resuming its original position intermediate and adjacent to said tracks when said impact force is removed.

9. An impact resistant overhead door assembly movable on track means from a closed lowered position to an open raised position, said door assembly comprising:

at least one rigid panel having a front and back face, two lateral ends, and a top and bottom edge;

guide means secured to said rigid panel for engaging said tracks and guiding the movement of said rigid panel along said tracks;

a flexible, resilient bottom panel adjacent said rigid panel, said resilient bottom panel having a front and back face, two lateral ends and a top and bottom edge said bottom panel having a vertical end member at each lateral end for providing support and rendering said flexible resilient bottom panel substantial inflexible to vertical compressive forces but allowing movement of said panel in response to horizontal forces directed against said front and back faces;

panel hinge means pivotally coupling said bottom panel to said adjacent rigid panel;

guide means and detachable coupling means, said guide means for engaging said tracks and guiding the movement of said flexible panel, said detachable coupling means affixed to said bottom panel towards said bottom edge, and releasbly engaged to said guide means to releasably secure said flexible panel to said track.

10. The door assembly of claim 9 further comprising a U-shaped, flexible nosing seal coupled to the lower edge portion of said bottom panel, said nosing seal adapted to be positioned immediately adjacent a threshhold of an opening with said door assembly in a closed position.

11. The door assembly of claim 9 wherein said front and back face of said flexible resilient bottom panel include rubber surfaces and a polyurethane foam filler incorporated therebetween.

12. The door assembly of claim 9 wherein said bottom panel vertical end members are of metal composition and said bottom panel further comprises rubber horizontal and vertical reinforcing members, said rubber horizontal members positioned in close proximity to said upper and lower edges of said bottom panel, and said rubber vertical reinforcing members positioned between said metal edge reinforcing members respectively.

13. An impact resistant overhead door assembly movable on track means from a closed lowered position to an open raised position, said door assembly comprising:

at least one rigid panel having a front and back face, two lateral ends, and a top and bottom edge;

guide means secured to said rigid panel for engaging said tracks and guiding the movement of said rigid panel along said tracks from said closed lowered position and said raised open position;

a flexible, resilient bottom panel adjacent said rigid panel, said resilient bottom panel having a front and back face, two lateral ends and a top and bottom edge, said bottom panel having a vertical end member at each lateral end for providing support and reinforcement therefore while permitting movement of said panel in response to horizontal forces directed against said front and back faces;

panel hinge means pivotally coupling said bottom panel to said adjacent rigid panel;

guide means and coupling means, said guide means for engaging said tracks and guiding the movement of said flexible panel, said coupling means affixed to said bottom panel towards said bottom edge and engaged to said guide means to releasably secure said flexible panel to said track and to permit release of said flexible bottom panel from said guide means when said door assembly is impacted with a horizontal force when said door assembly is positioned between said closed lowered position and said open raised position; and a U-shaped, flexible nosing seal coupled to the lower edge portion of said bottom panel, said nosing seal adapted to be positioned immediately adjacent a threshold of an opening with said door assembly in a closed position to render said flexible bottom panel substantially inflexible.

* * * * *

UNITED STATES PATENT AND TRADEMARK OFFICE

CERTIFICATE OF CORRECTION

PATENT NO. : 4,676,293

DATED : June 30, 1987

INVENTOR(S) : David H. Hanssen

It is certified that error appears in the above—identified patent and that said Letters Patent is hereby corrected as shown below:

Cover page should indicate 5 Drawing Figures rather than 7.

Column 2, line 62, after "section;" insert -- and --.

line 64, after "4" delete the semicolon (;) and insert a period (.).

lines 65-68, delete "FIG. 6 is a fragmentary top plan view showing displacement of the door outwardly with respect to the door opening in accordance with the present invention; and".

Column 3, lines 1-3, delete "FIG. 7 is a fragmentary top plan view showing displacement of the door inwardly with respect to the door opening in accordance with the present invention."

Column 7, line 49, "releasbly" should be -- releasably --.

Signed and Sealed this

Twenty-second Day of March, 1988

*Attest:*

DONALD J. QUIGG

*Attesting Officer*

*Commissioner of Patents and Trademarks*